US008742240B2

(12) United States Patent
Sato

(10) Patent No.: US 8,742,240 B2
(45) Date of Patent: Jun. 3, 2014

(54) TOM HOLDER

(75) Inventor: Naoki Sato, Nagoya (JP)

(73) Assignee: Hosino Gakki Co., Ltd, Aichi (JP)

( * ) Notice: Subject to any disclaimer, the term of this patent is extended or adjusted under 35 U.S.C. 154(b) by 244 days.

(21) Appl. No.: 12/978,283

(22) Filed: Dec. 23, 2010

(65) Prior Publication Data

US 2012/0118126 A1 May 17, 2012

(30) Foreign Application Priority Data

Nov. 16, 2010 (JP) ..... 2010-255663

(51) Int. Cl.
*G10D 13/02* (2006.01)

(52) U.S. Cl.
USPC ..... 84/421

(58) Field of Classification Search
USPC ..... 84/421
See application file for complete search history.

(56) References Cited

U.S. PATENT DOCUMENTS 4,126,075 A * 11/1978 Kurosaki ..... 84/421
4,158,981 A * 6/1979 Kurosaki ..... 84/421
5,566,911 A * 10/1996 Hoshino ..... 248/124.1
5,803,642 A * 9/1998 Sassmannshausen ..... 403/90
5,895,874 A * 4/1999 Liao ..... 84/421
5,973,248 A * 10/1999 Chen ..... 84/421
6,346,665 B1 * 2/2002 Liao ..... 84/421
8,106,278 B2 * 1/2012 Eason ..... 84/421

FOREIGN PATENT DOCUMENTS

JP 59-1094 U 1/1984
JP 61-132899 U 8/1986
JP 63-24598 U 2/1988
JP 3004275 U 8/1994
JP 3014483 U 5/1995
JP 2007-079437 A 3/2007

OTHER PUBLICATIONS

Japanese Office Action dated Oct. 2, 2012 issued in the application No. 2010-255663.

* cited by examiner

*Primary Examiner* — Christopher Uhlir

(57) ABSTRACT

A tom holder has a holder body, a pivoting member supported pivotably with respect to the holder body, and a rod, which projects from the pivoting member with the tom fixed to the rod. The tom holder has a pair of openings located at opposed positions. The tom holder is configured to be usable in either a first mode, in which the rod projects from the first opening, and a second mode, in which the rod projects from the second opening.

8 Claims, 8 Drawing Sheets

TOM HOLDER

BACKGROUND OF THE INVENTION

The present invention relates to a tom holder used to attach a tom to a musical instrument stand.

Typically, a drum set includes percussion instruments such as a bass drum, a snare drum, a tom, and cymbals, which are arranged in such a manner as to allow a single player to play the instruments. Specifically, the tom may be supported by a cymbal stand using a clamp and a tom adapter. However, this supporting method requires a plurality of components to support the tom from the cymbal stand, thus increasing costs.

As described in U.S. Pat. No. 6,346,665, for example, a tom holder functioning as both a clamp and a tom adapter has been proposed. With reference to FIG. 11, a tom holder 100, as disclosed in this document, includes a holder 102 formed integrally with a sleeve 101, a ball 103 supported by the holder 102, and a rod 104, which is fixed to the ball 103, extends in an L-shaped manner. The holder 102 has a clamp structure configured by a pair of clamp pieces 102*a*, 102*b*. The ball 103 is pivotably supported by the clamp pieces 102*a*, 102*b*. The rod 104 projects from an opening 105, which is formed in a front surface of the holder 102. A tom T is fixed to a portion of the rod 104 extending upward through a fixing tool TA. This type of tom holder 100 is attached directly to a support pipe BP extending from a bass drum B through the sleeve 101. The position of the tom T, which is fixed to the rod 104, may be adjusted by pivoting the ball 103 received in the holder 102. The tom holder 100 may be used to attach the tom T to a cymbal stand or a support pipe of a tom stand, other than the mode of use illustrated in FIG. 11.

However, the tom holder 100 shown in FIG. 11 has only one opening, which is the opening 105 formed in the front surface of the holder 102. The area of the opening 105, which defines the movement range of the rod 104, is set to a comparatively small value. This reduces the movement range of the rod 104 and thus the adjustment range of the position of the tom T. To enlarge the adjustment range of the position of the tom T, the bass drum or the cymbal stand must be moved, which is troublesome and complicated for the player. If the cymbal stand is moved, the positions of the cymbals must be readjusted, which involves otherwise unnecessary work.

SUMMARY OF THE INVENTION

Accordingly, it is an objective of the present invention to provide a tom holder that is capable of enlarging the adjustment range of the position of a tom.

To achieve the foregoing objective and in accordance with one aspect of the present invention, a tom holder used to attach a tom to a support pipe is provided. The tom holder includes a holder body, a pivoting member supported pivotably with respect to the holder body, and a rod projecting from the pivoting member. The tom is fixed to the rod. A pair of openings are formed in the holder body. The openings are arranged at opposed positions. The tom holder is configured to be usable in either a first mode, in which the rod projects from a first opening, or a second mode, in which the rod projects from a second opening.

DETAILED DESCRIPTION OF THE PREFERRED EMBODIMENTS (First Embodiment)

A first embodiment of a tom holder according to the present invention will now be described with reference to FIGS. 1 to 6B.

Figure 1:
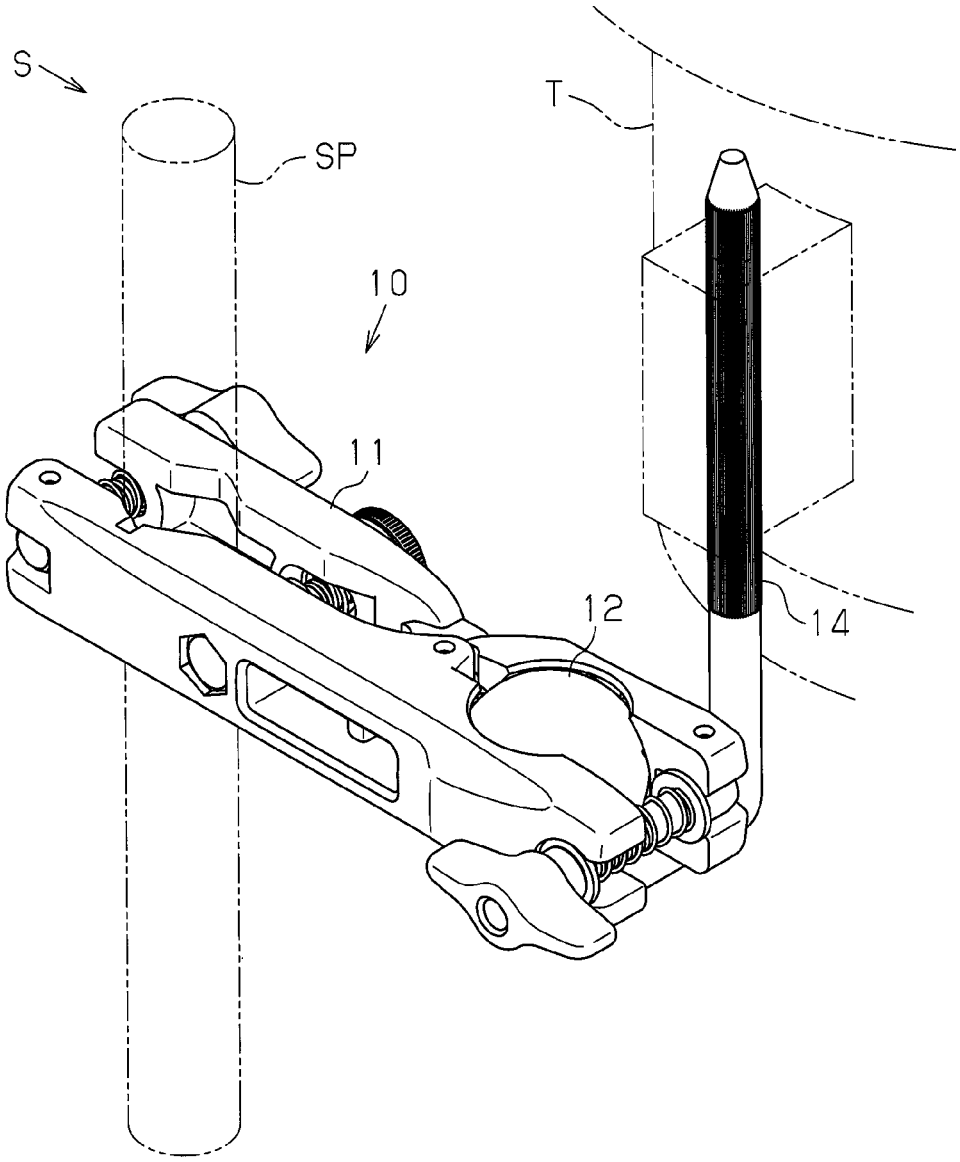
FIG. 1 is a perspective view showing a tom holder according to a first embodiment of the present invention.

As illustrated in FIG. 1, a tom holder 10 has a holder body 11, a pivoting member 12 supported pivotably with respect to the holder body 11, and a rod 14 to which a tom T is fixed. The tom holder 10 is used to attach the tom T to a support pipe SP of a cymbal stand S.

Figure 2:
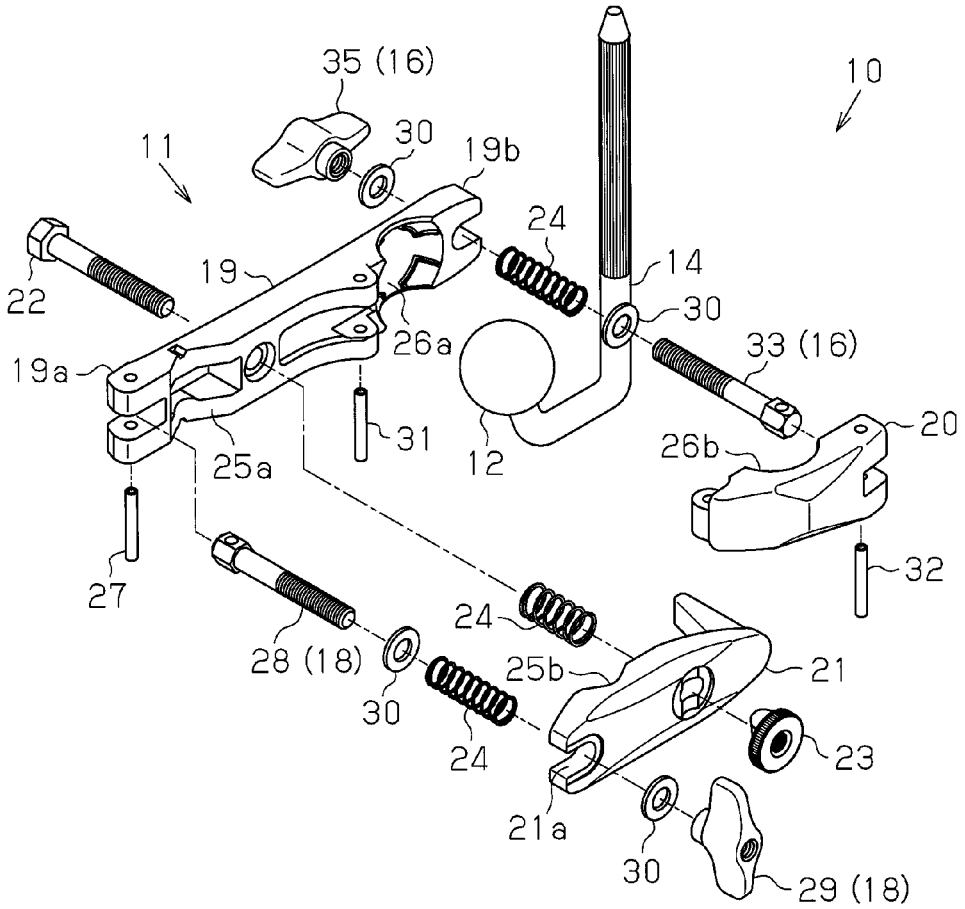
FIG. 2 is an exploded perspective view showing the tom holder.
Figure 3:
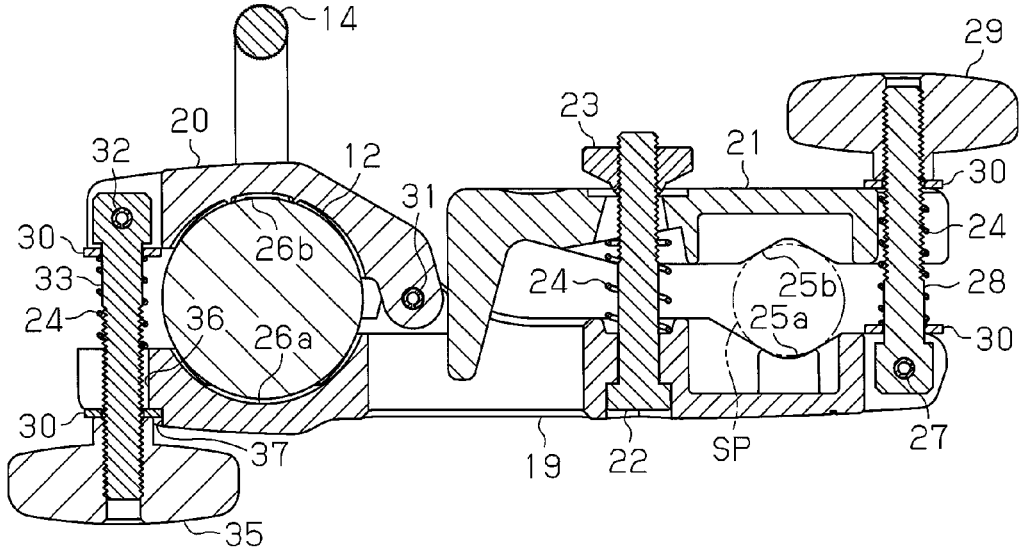
FIG. 3 is an upper cross-sectional view showing the tom holder.

As illustrated in FIGS. 2 and 3, the pivoting member 12 is made of synthetic resin and shaped spherically. The rod 14 is made of metal and has a U shape. The rod 14 projects from the pivoting member 12 and is fixed to the pivoting member 12. The rod 14 and the pivoting member 12 are formed as an integral component and incorporated in the holder body 11.

The holder body 11 has a first clamp structure and a second clamp structure. The first clamp structure clamps the pivoting member 12 by means of a first fastening member 16. The second clamp structure clamps the support pipe SP by means of a second fastening member 18. The holder body 11 has an elongated clamp body 19, a first clamp piece 20, and a second clamp piece 21. The first clamp piece 20, together with the clamp body 19, configures the first clamp structure. The second clamp piece 21, together with the clamp body 19, configures the second clamp structure.

A bolt 22 is supported at a center portion of the clamp body 19 with the distal end of the bolt 22 facing sideward. The distal end of the bolt 22 extends through the center portion of the second clamp piece 21. A nut 23 is threaded onto the distal end of the bolt 22. A coil spring 24 is arranged around the shaft portion of the bolt 22. A recess 25*a* having a triangular cross section is formed in the inner surface of the clamp body 19 that faces the second clamp piece 21. A recess 26*a*, which forms a part of a sphere, is formed in the inner surface of the clamp body 19 facing the first clamp piece 20.

The proximal end of a second bolt 28 is pivotally connected to a first end 19*a* of the clamp body 19 through a support pin 27. A butterfly nut 29 serving as a second nut is threaded onto the distal end of the second bolt 28. Another coil spring 24 and a washer 30 are arranged around the shaft portion of the second bolt 28. The second bolt 28 and the butterfly nut 29 configure the second fastening member 18.

The second clamp piece 21 is detachably attached to the clamp body 19. The second clamp piece 21, together with the clamp body 19, supports the support pipe SP from lateral sides. For this purpose, a recess 25*b* having a triangular cross section is formed in the inner surface of the second clamp piece 21 in a similar manner to the corresponding recess in the clamp body 19. A space for accommodating the support pipe SP is formed between the recess 25*b* of the second clamp piece 21 and the recess 25*a* of the clamp body 19. A support recess 21*a* for supporting the shaft portion of the second bolt 28 is formed at a distal end of the second clamp piece 21.

The first clamp piece 20 is fastened to a second end 19*b* of the clamp body 19 by means of the first fastening member 16. The first clamp piece 20 is detachably attached to the clamp body 19. The first clamp piece 20, together with the clamp body 19, supports the pivoting member 12 from lateral sides. For this purpose, a recess 26*b*, which forms a part of a sphere, is formed in the inner surface of the first clamp piece 20 in a similar manner to the corresponding recess in the clamp body 19. The space for accommodating the pivoting member 12 is formed between the recess 26*b* of the first clamp piece 20 and the recess 26*a* of the clamp body 19.

The first clamp piece 20 is pivotally connected to the clamp body 19 through a support pin 31. The proximal end of a first bolt 33 is pivotally connected to a distal end of the first clamp piece 20 through a support pin 32. A butterfly nut 35 serving as a first nut is threaded onto the distal end of the first bolt 33. Another coil spring 24 and another washer 30 are arranged around the shaft portion of the first bolt 33. The first bolt 33 and the butterfly nut 35 configure the first fastening member 16.

Figure 4:
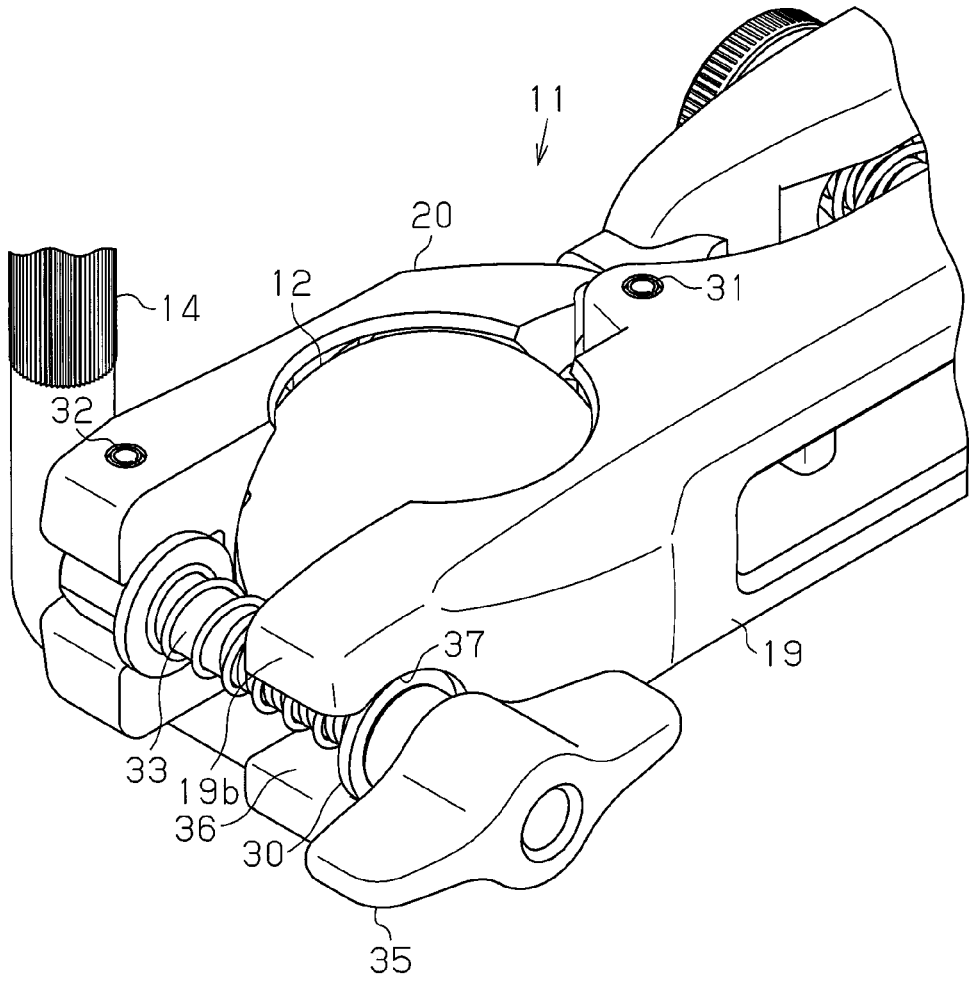
FIG. 4 is an enlarged partial perspective view showing a first clamp structure of the tom holder.

With reference to FIGS. 3 and 4, a support recess 36 for supporting the shaft portion of the first bolt 33 is formed in the second end 19*b* of the clamp body 19. A groove 37 having a shape corresponding to the shape of the washer 30 is formed in a distal end of the clamp body 19. The groove 37 is arranged adjacent to the support recess 36. The groove 37 in the clamp body 19 is sized and shaped in such a manner as to allow the washer 30 to be fitted in the groove 37 by fastening the butterfly nut 35. The groove 37 in the clamp body 19 and the washer 30 are restriction means for restricting pivot of the first bolt 33 with respect to the holder body 11. In other words, even if the butterfly nut 35 is loosened, the groove 37 in the clamp body 19 and the washer 30 maintain and prevent the first bolt 33 from pivoting with respect to the holder body 11 as long as the loosening amount of the butterfly nut 35 is not more than a predetermined value.

Operation of the tom holder 10 will hereafter be described with reference to FIGS. 5A to 6B.

Figure 5A:
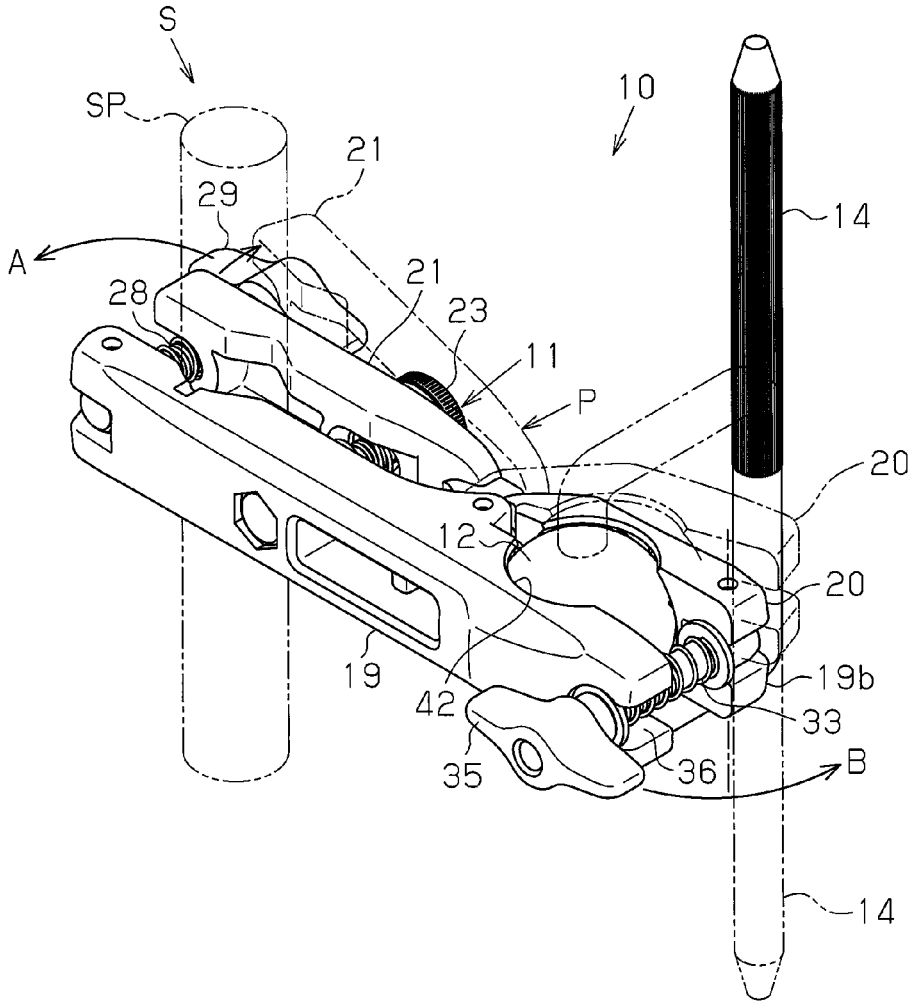
FIG. 5A is a perspective view showing a first mode of the tom holder.
Figure 5B:
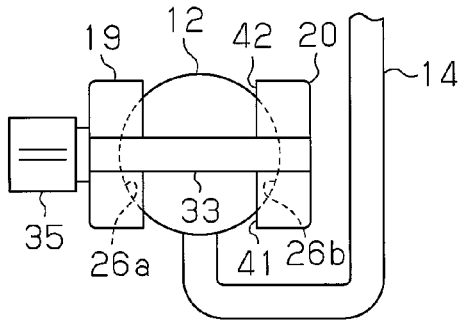
FIG. 5B is a front view schematically showing the first mode of the tom holder.

As illustrated in FIGS. 5A to 6B, the tom holder 10 has a pair of openings 41, 42, which are arranged at opposed positions. FIGS. 5A and 5B show the tom holder 10 in a first mode, in which the first opening 41 is located in a lower surface of the holder body 11, and the second opening 42 is arranged in an upper surface of the holder body 11. The first opening 41 is an opening facing downward, as viewed in FIGS. 5A and 5B, in the space between the recess 26*b* of the first clamp piece 20 and the recess 26*a* of the clamp body 19. The second opening 42 is an opening facing upward, as viewed in FIGS. 5A and 5B, in the space between the recess 26*b* of the first clamp piece 20 and the recess 26*a* of the clamp body 19. In the first mode, the pivoting member 12 is clamped between the clamp body 19 and the first clamp piece 20 with the rod 14 projecting from the opening 41 and the distal end of the rod 14 extending upward. In this mode, the rod 14 is located at the opposite side to the butterfly nut 35 with respect to the holder body 11.

To remove the tom holder 10 from the support pipe SP of the cymbal stand S, the butterfly nut 29 is loosened from the second bolt 28, and then the second bolt 28 is rotated in direction A, as indicated in FIG. 5A, with respect to the clamp body 19. Subsequently, the proximal end of the second clamp piece 21 is pressed in direction P, as indicated in FIG. 5A. This separates the distal end of the second clamp piece 21 from the clamp body 19, as indicated by the corresponding alternate long-and-two-short dashed lines in FIG. 5A, thus opening the end of the holder body 11 that fastens the support pipe SP. Through the series of operation, the tom holder 10 is detached from the support pipe SP of the cymbal stand S.

Next, the tom holder 10 is switched from the first mode to a second mode. Specifically, the butterfly nut 35 is first loosened from the first bolt 33, and then the first bolt 33 is rotated in direction B, as indicated in FIG. 5A, with respect to the first clamp piece 20. Subsequently, as indicated by the corresponding alternate long-and-two-short dashed lines in the drawing, the first clamp piece 20 is pivoted with respect to the clamp body 19 so as to separate the distal end of the first clamp piece 20 from the clamp body 19. This opens the end of the holder body 11 that fastens the pivoting member 12. Then, the pivoting member 12 may be pivoted in the holder body 11 or removed from the holder body 11, re-oriented, and mounted in the holder body 11, in such a manner that the rod 14 projects from the second opening 42 with the distal end of the rod 14 facing downward, as indicated by the corresponding alternate long-and-two-short dashed lines in FIG. 5A. After the pivoting member 12 is re-oriented in this manner, the open end of the holder body 11 is closed and the first bolt 33 is arranged in the support recess 36 in the clamp body 19. The butterfly nut 35 is then fastened to the first bolt 33. As a result, the pivoting member 12 is clamped between the clamp body 19 and the first clamp piece 20 in the state illustrated by the corresponding alternate long-and-two-short dashed lines in FIG. 5A.

Figure 6A:
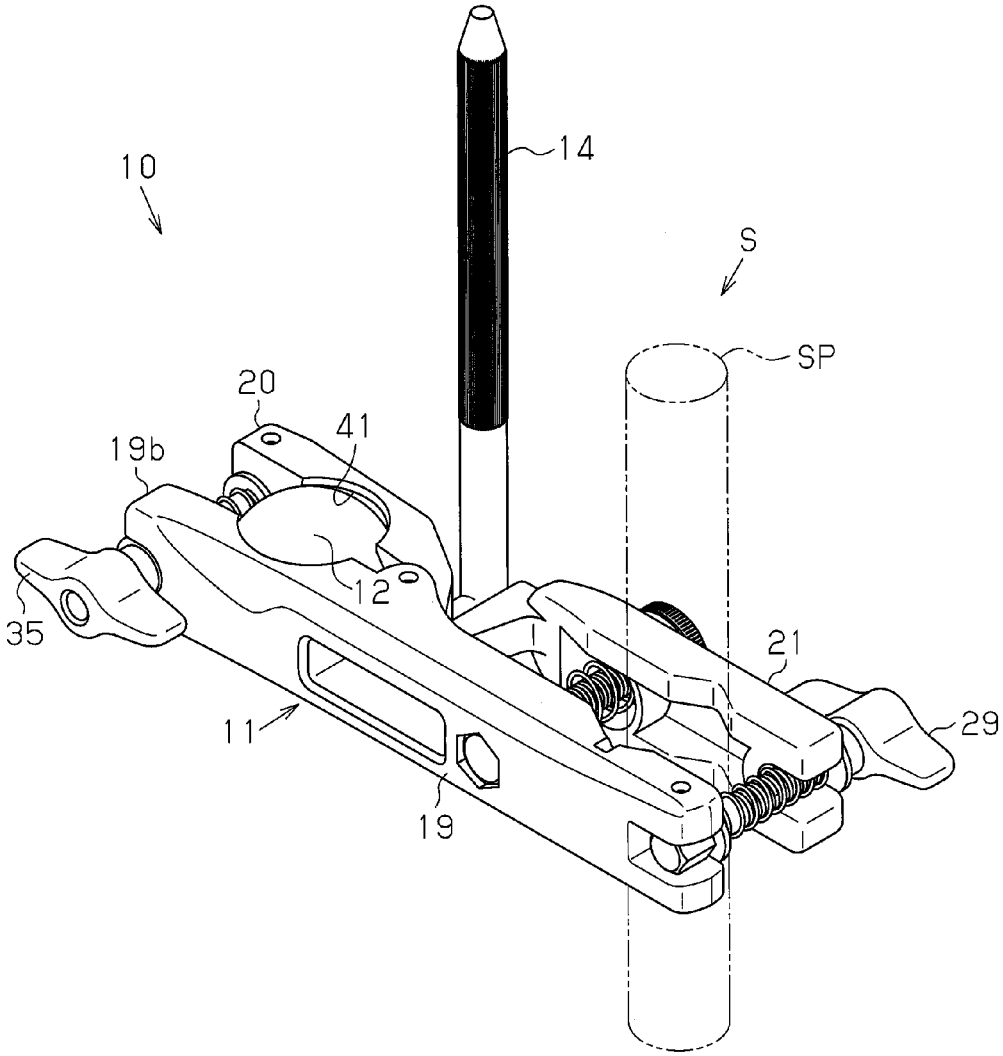
FIG. 6A is a perspective view showing a second mode of the tom holder.
Figure 6B:
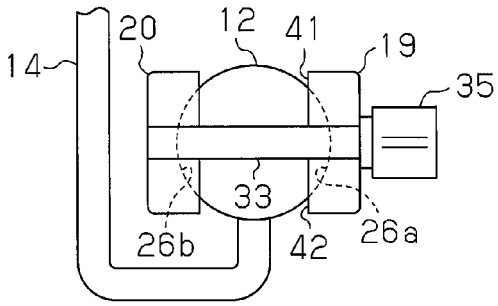
FIG. 6B is a front view schematically showing the second mode of the tom holder.

Further, as illustrated in FIGS. 6A and 6B, the tom holder 10 is reversed upside down, and then the tom holder 10 is attached to the support pipe SP of the cymbal stand S. FIGS. 6A and 6B show the tom holder 10 in the second mode, in which the second opening 42 is arranged in a lower surface of the holder body 11 and the first opening 41 is located in an upper surface of the holder body 11. Also in this mode, the rod 14 is arranged at the opposite side to the butterfly nut 35 with respect to the holder body 11. To attach the tom holder 10 to the support pipe SP, the removal procedure of the tom holder 10 from the support pipe SP is performed in reverse order.

The first embodiment has the advantages described below.

(1) The tom holder 10 has the two openings 41, 42, which are located at opposed positions. In this configuration, the movement range of the rod 14 is ensured at each of the opposed positions of the holder body 11. In other words, the tom holder 10 may be employed in either the first mode, in which the rod 14 projects from the first opening 41, or the second mode, in which the rod 14 projects from the second opening 42. As a result, compared to the conventional configuration having the only one opening formed in the front surface of the clamp, the movement range of the rod 14 is enlarged, thus also enlarging the adjustment range of the position of the tom T.

(2) The pivoting member 12 is formed in a spherical shape. The recess 26*a*, which forms a part of a sphere, is formed in the inner surface of the clamp body 19 facing the first clamp piece 20. Also, the recess 26*b*, which forms a part of a sphere, is arranged in the inner surface of the first clamp piece 20. In this configuration, the recess 26*a* in the clamp body 19 and the recess 26*b* of the first clamp piece 20 hold the pivoting member 12 in a pivotable manner. This further enlarges the movement range of the rod 14, thus enlarging the adjustment range of the position of the tom T to a greater extent.

(3) The holder body 11 has the first clamp structure, which fastens and holds the pivoting member 12 by means of the first fastening member 16. The proximal end of the first bolt 33, which forms the first fastening member 16, is pivotally connected to the distal end of the first clamp piece 20. In this configuration, by pivoting the first bolt 33 with respect to the first clamp piece 20, the portion of the holder body 11 for clamping the pivoting member 12 is opened. This facilitates attachment and detachment of the pivoting member 12 with respect to the holder body 11. Since the first bolt 33 is connected to the holder body 11 in advance, the first bolt 33 and the butterfly nut 35 are prevented from separating from the holder body 11.

(4) There are cases in which the butterfly nut 35 is loosened only slightly from the first bolt 33 in order to, for example, pivot the pivoting member 12 in the holder body 11 and adjust the position of the tom T. In these cases, the first bolt 33 may be released from the support recess 36 of the clamp body 19 to open the end of the holder body 11 that holds the pivoting member 12, thus causing the tom T to fall. However, according to the present invention, the groove 37 in the clamp body 19 and the washer 30 are provided as the restriction means for restricting pivot of the first bolt 33 with respect to the holder body 11. Accordingly, even if the butterfly nut 35 is loosened, the restriction means restricts the pivot of the first bolt 33 with respect to the holder body 11 as long as the loosening amount of the butterfly nut 35 is not more than the predetermined value. This stops the end of the holder body 11 holding the pivoting member 12 from opening at an undesirable time. As a result, when the butterfly nut 35 is loosened from the first bolt 33, the end of the holder body 11 clamping the pivoting member 12 is prevented from opening and releasing the tom T.

In contrast, by loosening the butterfly nut 35 from the first bolt 33 by an amount greater than or equal to a predetermined value, the pivoting member 12 can be pivoted smoothly in the holder body 11 or removed from the holder body 11. This facilitates the operation for switching the tom holder 10 from the first mode to the second mode.

(5) The proximal end of the second bolt 28 is pivotally connected to the first end 19*a* of the clamp body 19. The holder body 11 has the second clamp structure that fastens and holds the support pipe SP by means of the second fastening member 18. This configuration allows attachment of the tom holder 10 to the support pipe SP of the cymbal stand S using the second bolt 28 and the butterfly nut 29. Further, by pivoting the second bolt 28 with respect to the holder body 11, the end of the holder body 11 clamping the support pipe SP is opened. This facilitates attachment and detachment of the tom holder 10 with respect to the support pipe SP. Switching from the first mode to the second mode, which involves upside-down reversal of the tom holder 10 and re-mounting of the tom holder 10 onto the support pipe SP, is also facilitated.

(6) The pivoting member 12 is clamped between the clamp body 19 and the first clamp piece 20 with the rod 14 projecting from the first opening 41 and the distal end of the rod 14 extending upward. This arrangement enlarges the movement range of the rod 14. As a result, the adjustment range of the position of the tom T is further enlarged.

(7) The rod 14 is arranged at the opposite side to the butterfly nut 35 with respect to the holder body 11. This arrangement prevents the tom T from interfering with the butterfly nut 35 when the butterfly nut 35 is fastened or loosened, unlike an arrangement having the rod 14 and the butterfly nut 35 arranged at the same side with respect to the holder body 11. As a result, the position of the tom T is adjusted easily.

(Second Embodiment)

A tom holder 50 according to a second embodiment of the present invention will now be described with reference to FIGS. 7 to 8B. Detailed description of components of the second embodiment that are like or the same as corresponding components of the first embodiment will be omitted herein.

Figure 7:
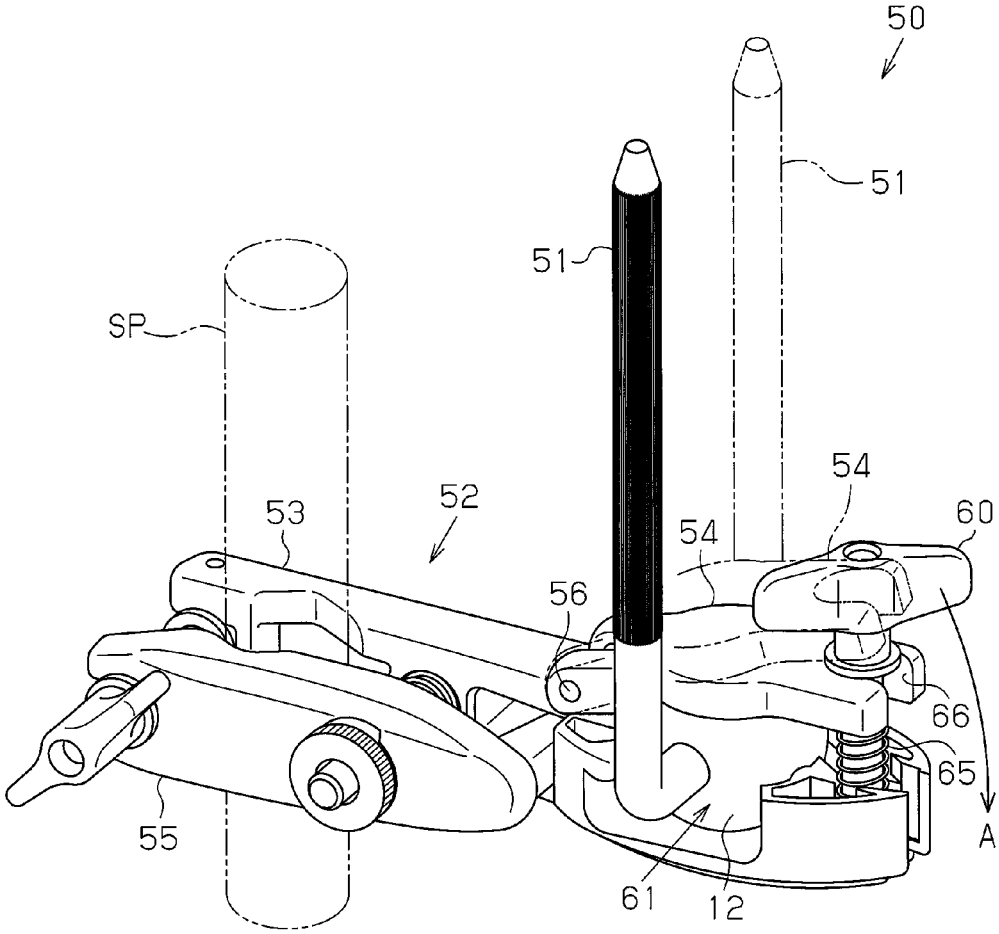
FIG. 7 is a perspective view showing a tom holder according to a second embodiment of the present invention.

As illustrated in FIG. 7, a rod 51 is formed in an L shape. A holder body 52 has an elongated clamp body 53, a first clamp piece 54 forming a first clamp structure together with the clamp body 53, and a second clamp piece 55 forming a second clamp structure together with the clamp body 53. The first clamp piece 54, together with the clamp body 53, supports the pivoting member 12 from above and below. The first clamp piece 54 is pivotally connected to the clamp body 53 through a support pin 56.

Operation of the above-described tom holder 50 will hereafter be described with reference to FIGS. 7 to 8B.

Figure 8A:
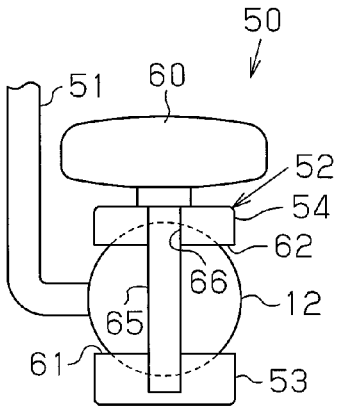
FIG. 8A is a front view schematically showing a first mode of the tom holder.
Figure 8B:
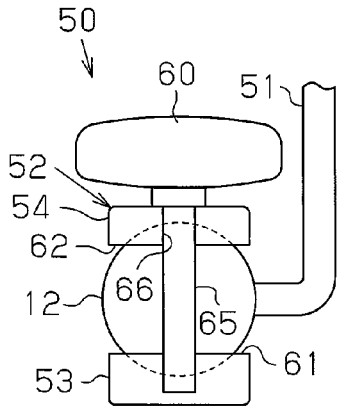
FIG. 8B is a front view schematically showing a second mode of the tom holder.

As illustrated in FIGS. 8A and 8B, the tom holder 50 has a pair of openings 61, 62, which are formed at opposed positions. FIGS. 7 and 8A show the tom holder 50 in a first mode, in which the first opening 61 is arranged in a left surface of the holder body 52 and the second opening 62 is located in a right surface of the holder body 52. In this mode, the pivoting member 12 is clamped between the clamp body 53 and the first clamp piece 54 with the rod 51 projecting from the first opening 61 and the distal end of the rod 51 extending upward.

To switch the tom holder 50 from the first mode to a second mode, a butterfly nut 60 is first loosened from a first bolt 65, and then the first bolt 65 is rotated in direction A, as indicated in FIG. 7, with respect to the clamp body 53. Subsequently, as indicated by the corresponding alternate long-and-two-short dashed lines in the drawing, the first clamp piece 54 is pivoted upward with respect to the clamp body 53 to open the end of the holder body 52 having the first clamp structure. Then, to project the rod 51 from the second opening 62, as indicated by the corresponding alternate long-and-two-short dashed lines in FIG. 7 and represented in FIG. 8B, the pivoting member 12 is pivoted in the holder body 52 with the distal end of the rod 51 maintained in a state facing upward.

Subsequently, the open end of the holder body 52 is closed and the first bolt 65 is arranged in a support recess 66 formed in the first clamp piece 54. The butterfly nut 60 is then fastened to the first bolt 65. This clamps the pivoting member 12 between the clamp body 53 and the first clamp piece 54 with the rod 51 projecting from the second opening 62 and the distal end of the rod 51 extending upward. Through this series of operation, the tom holder 50 is switched from the first mode to the second mode.

The second embodiment has the advantage described below.

(8) The tom holder 50 has the two openings 61, 62, which are located at opposed positions. In this configuration, as in the first embodiment, the movement range of the rod 51 is ensured at each of the opposed positions of the holder body 52. In other words, the tom holder 50 can be arranged in either the first mode, in which the rod 51 projects from the first opening 61, or the second mode, in which the rod 51 projects from the second opening 62. This configuration enlarges the movement range of the rod 51 and thus the adjustment range of the position of the tom T, compared to the conventional configuration having only one opening formed in the front surface of the clamp. Also, the above-described configuration allows switching of the tom holder 50 from the first mode to the second mode without removing the tom holder 50 from the support pipe SP.

The illustrated embodiments may be modified as follows.

Figure 9:
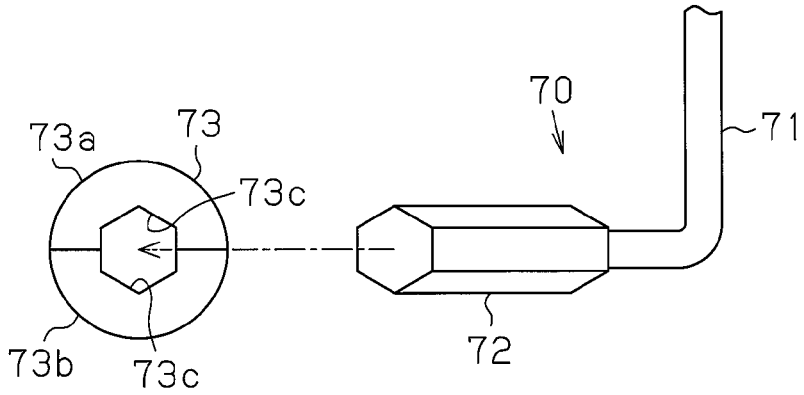
FIG. 9 is a view schematically showing a rod and a pivoting member of according to a modification.

In each of the above illustrated embodiments, the rod is fixed to the pivoting member. However, the rod may be formed in a manner attachable/detachable with respect to the pivoting member. For example, as illustrated in FIG. 9, a rod 70 has an L-shaped shaft portion 71 and a proximal portion 72 having a hexagonal cross section. A pivoting member 73 is divided into a first member 73*a* and a second member 73*b*, The first and second members 73*a*, 73*b* each have a groove 73*c*, which extends along the axis of the first or second member 73*a*, 73*b*. By arranging the grooves 73*c* of the first and second members 73*a*, 73*b* to face each other, a hole having a hexagonal cross section capable of receiving the proximal portion 72 of the rod 70 is formed. The pivoting member 73 is held pivotably by a holder body having a clamp structure. This configuration allows exchange of the rod 70 in correspondence with the type of tom and in response to needs of the player.

Figure 10A:
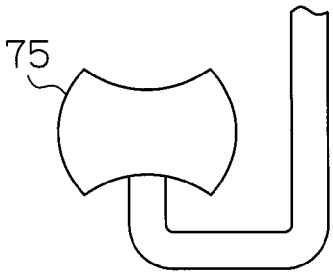
FIG. 10A is a view schematically showing a pivoting member according to another modification.
Figure 10B:
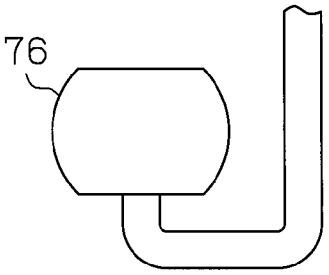
FIG. 10B is a view schematically showing a pivoting member according to another modification.
Figure 11:
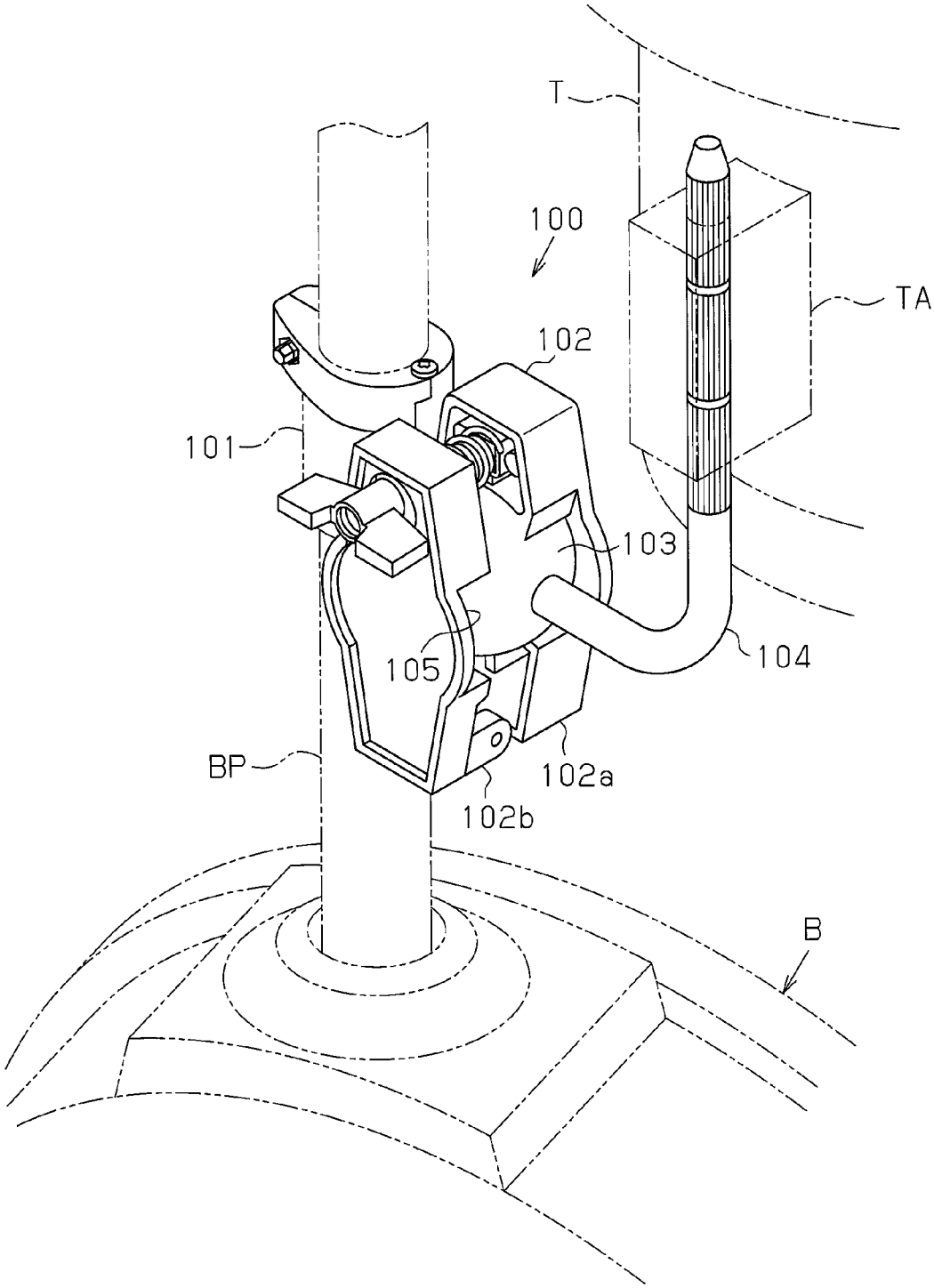
Fig.11 Prior Art
FIG. 11 is a perspective view showing a conventional tom holder.

In each of the above illustrated embodiments, other than spherical bodies, pivoting members 75, 76 each formed by cutting portions of a spherical body, as illustrated in FIGS. 10A and 10B, may be employed.

In the first embodiment, the rod 14 may be arranged at the same side with the butterfly nut 35 with respect to the holder body 11.

In the second embodiment, the restriction means for restricting the pivot of the first bolt 65 may be arranged in an upper surface of the first clamp piece 54. The restriction means may be formed by, for example, a washer arranged between the butterfly nut 60 and the first clamp piece 54 and a groove that is formed in the upper surface of the first clamp piece 54 and receives the washer, as in the first embodiment.

In the first and second embodiments, the tom holders 10, 50 may be employed to attach the tom T to a tom stand or a support pipe of a bass drum, other than the cymbal stand.

The invention claim is:

1. A tom holder used to attach a tom to a support pipe, the tom holder comprising:

a holder body;

a pivoting member supported pivotally with respect to the holder body; and a rod projecting from the pivoting member, wherein the rod is U-shaped, the rod is adapted to be fixed to the tom, first and second openings are formed in opposite surfaces of the holder body, respectively, the pivoting member is clamped such that the rod projects from one of the first and second openings that is arranged in the lower surface of the holder body and such that a distal end of the rod extends upward, the tom holder is configured to be selectively usable in a first mode and a second mode, and in the second mode, the tom holder is upside-down with respect to the first mode, in the first mode, the rod projects from the first opening, which is located in the lower surface of the holder body, and in the second mode, the rod projects from the second opening, which is located in the lower surface of the holder body.

2. The tom holder according to claim 1, wherein the holder body has a first clamp structure that fastens and holds the pivoting member by a first fastening member, the pivoting member is formed in a spherical shape, the holder body has a recess forming a part of a sphere, and the pivoting member is received in the recess of the holder body.

3. The tom holder according to claim 2, wherein a portion of the holder body that clamps the pivoting member is selectively opened and closed, the first fastening member includes a first bolt and a first nut threaded onto a distal end of the first bolt, and the first bolt is pivotally connected to a distal end of the portion of the holder body that clamps the pivoting member.

4. The tom holder according to claim 3, wherein the holder body includes a restriction for restricting pivotal motion of the first bolt with respect to the holder body.

5. The tom holder according to claim 2, wherein the holder body further includes a second clamp structure that fastens and holds the support pipe by a second fastening member, a portion of the holder body that clamps the support pipe is selectively opened and closed, the second fastening member is formed by a second bolt and a second nut threaded onto a distal end of the second bolt, and the second bolt is pivotally connected to a distal end of the portion of the holder body that clamps the support pipe.

6. The tom holder according to claim 3, wherein the rod is arranged at an opposite side of the holder body with respect to the first nut.

7. A tom holder used to attach a tom to a support pipe, the tom holder comprising:

a holder body that defines a first opening, a second opening, and a third opening, wherein the first and second openings are formed in opposite surfaces of the holder body, respectively, and the third opening is operative to engage and secure the holder body to the support pipe;

a pivoting member supported pivotally with respect to the holder body; and a rod projecting from the pivoting member, wherein the rod is U-shaped, the pivoting member is clamped such that the rod projects from one of the first and second openings that is arranged in the lower surface of the holder body and such that a distal end of the rod extends upward, the tom holder is configured to be arranged in two selectable modes of operation, and the modes are a first mode and a second mode, and in the second mode, the tom holder is upside-down with respect to the first mode, in the first mode, the rod projects from the first opening, which is located in the lower surface of the holder body, and in the second mode, rod projects from the second opening, which is located in the lower surface of the holder body.

8. A tom holder used to attach a tom to a support pipe, the tom holder comprising:

a holder body having a first clamp opening operative to engage the support pipe and secure the holder body to the support pipe;

a pivoting member supported pivotally with respect to the holder body; and a rod projecting from the pivoting member, wherein the rod is U-shaped, the rod is adapted to be fixed to the tom, the holder body includes first and second openings formed in opposite surfaces of the holder body, respectively, the pivoting member is clamped such that the rod projects from one of the first and second openings that is arranged in the lower surface of the holder body and such that a distal end of the rod extends upward, the tom holder is configured to be usable in two modes, the modes are a first mode and a second mode, and, in the second mode, the tom holder is upside-down with respect to the first mode, in the first mode, the rod projects from the first opening, which is located in the lower surface of the holder body, and in the second mode, the rod projects from the second opening, which is located in the lower surface of the holder body.

* * * * *